US008170456B2

(12) United States Patent
Young

(10) Patent No.: US 8,170,456 B2
(45) Date of Patent: May 1, 2012

(54) METHOD AND SYSTEM FOR IMPROVING IMAGE ON PAPER REGISTRATION IN AN IMAGE PRINTING SYSTEM

(75) Inventor: Herman Young, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 695 days.

(21) Appl. No.: 12/233,003

(22) Filed: Sep. 18, 2008

(65) Prior Publication Data

US 2010/0067961 A1 Mar. 18, 2010

(51) Int. Cl.
*G03G 15/01* (2006.01)

(52) U.S. Cl. ..... 399/301

(58) Field of Classification Search ..... 399/301
See application file for complete search history.

(56) References Cited

U.S. PATENT DOCUMENTS

| | | | | |
|---|---|---|---|---|
| 4,971,304 | A | 11/1990 | Lofthus | |
| 5,278,589 | A | 1/1994 | Wong | |
| 5,365,074 | A | 11/1994 | Genovese | |
| 5,394,223 | A | 2/1995 | Hart et al. | |
| 5,555,084 | A | 9/1996 | Vetromile et al. | |
| 5,742,867 | A * | 4/1998 | Kodama | 399/49 |
| 6,002,890 | A | 12/1999 | Jackson et al. | |
| 6,201,937 | B1 | 3/2001 | Folkins | |
| 6,369,842 | B1 | 4/2002 | Abramsohn | |
| 6,373,042 | B1 | 4/2002 | Kretschmann et al. | |
| 6,904,255 | B2 | 6/2005 | Kera et al. | |
| 6,909,516 | B1 | 6/2005 | Hoover | |
| 6,934,498 | B2 * | 8/2005 | Kobayashi et al. | 399/301 |
| 7,177,585 | B2 | 2/2007 | Matsuzaka et al. | |
| 7,580,661 | B2 * | 8/2009 | Aikawa | 399/301 |
| 7,751,771 | B2 * | 7/2010 | Ubayashi | 399/395 |
| 2004/0190920 | A1 * | 9/2004 | Engeln et al. | 399/49 |
| 2007/0014595 | A1 * | 1/2007 | Kawagoe | 399/301 |
| 2007/0059053 | A1 * | 3/2007 | Namba | 399/301 |
| 2008/0069603 | A1 * | 3/2008 | Nakatsu | 399/301 |
| 2008/0129812 | A1 * | 6/2008 | Yamamoto | 347/116 |
| 2008/0253781 | A1 * | 10/2008 | Takezawa | 399/39 |
| 2009/0003893 | A1 * | 1/2009 | Nishikawa et al. | 399/301 |

* cited by examiner

*Primary Examiner* — Quana M Grainger
(74) *Attorney, Agent, or Firm* — Pillsbury Winthrop Shaw Pittman LLP

(57) ABSTRACT

The present disclosure provides a method for improving image on paper registration in an image printing system. The method includes advancing a target media along a media path; placing a plurality of registration marks adjacent to a toner image on an image bearing surface moving in a process direction, wherein the toner image is configured to be transferred to the target media; detecting positions of the registration marks using one or more sensors adjacent the image bearing surface; determining a correction function using the positions of the registration marks to compensate for an error in a registration of the toner image and the target media; adjusting the advancement of the target media based on the correction function; and transferring the toner image to the target media.

22 Claims, 4 Drawing Sheets

METHOD AND SYSTEM FOR IMPROVING IMAGE ON PAPER REGISTRATION IN AN IMAGE PRINTING SYSTEM

BACKGROUND

1. Field

The present disclosure relates to a system and a method for improving image on paper registration in an image printing system.

2. Description of Related Art

In a mechanical registration system, an operator or a service engineer visually sets the relative position of a media to an image by making adjustments to the media position. For example, the relative position of the media to the image is visually set by modifying the arrival time and/or location of the media with respect to the image on an image bearing surface (i.e., a photoreceptor belt or drum). Variations in theoretical arrival time and location of the image on the image bearing surface are averaged during an initial set up process of the image printing system. FIG. 1 shows a prior art image on paper registration system 500 that illustrates positional differences between an image 502 on an image bearing surface 504 and a media 506. As shown in the FIG. 1 (e.g., see the enlarged view of image 502 and media 506), near the transfer station, a positional difference D exists between the image 502 and the media 506.

Therefore, it is desirable to provide a system and a method to monitor the location of the image on the image bearing surface and to make adjustments to the media depending on the location of the image on the image bearing surface for improving image on paper registration in an image printing system.

SUMMARY

In one embodiment, a method for improving image on paper registration in an image printing system is provided. The method includes advancing a target media along a media path; placing a plurality of registration marks adjacent to a toner image on an image bearing surface moving in a process direction, wherein the toner image is configured to be transferred to the target media; detecting positions of the registration marks using one or more sensors adjacent the image bearing surface; determining a correction function using the positions of the registration marks to compensate for an error in a registration of the toner image and the target media; adjusting the advancement of the target media based on the correction function; and transferring the toner image to the target media.

In another embodiment, an image printing system for improving image on paper registration is provided. The image printing system includes a paper handling subsystem; a marking engine; one or more sensors; a processor and a controller. The paper handling subsystem is configured to advance a target media along a media path. The marking engine is configured to place a plurality of registration marks adjacent to a toner image on an image bearing surface moving in a process direction, wherein the toner image is configured to be transferred to the target media. The one or more sensors adjacent to the image bearing surface configured to detect positions of the registration marks. The processor is configured to determine a correction function using the positions of the registration marks to compensate for an error in a registration of the toner image and the target media. The controller is configured to adjust the advancement of the target media based on the correction function. The marking engine is further configured to transfer the toner image to the target media.

Other objects, features, and advantages of one or more embodiments will become apparent from the following detailed description, and accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

The present disclosure proposes a method and a system for improving image on paper registration in an image printing system. The present disclosure proposes addition of xerographically produced registration marks applied to an image bearing surface of the image printing system prior to an actual image, which is intended for transfer to a target media. The registration marks are then detected by a set of sensors. Any variations from the theoretical arrival time and location of the registration marks and image could then be compensated for in the media registration control by adjusting the media on to which the actual image is to be transferred, thus, any variations are compensated for and an improvement to the image on paper registration performance could be realized.

U.S. Pat. No. 5,555,084 (incorporated herein in its entirety by reference) proposes an apparatus for sheet to image registration system. This reference proposes monitoring latent target marks written on the photoreceptor and measuring the paper position. Once the paper position and the latent target marks are sensed by a sensor, an exact amount of paper to image misregistration is determined and correction to the next sheet or for the subsequent sheet is made in order to adjust the registration of the sheet to better approximate the sheet position to the image on the photoreceptor. This reference does not disclose adjusting the current sheet or paper (i.e., on to which the detected image is to be transferred) based on the position of the latent target marks detected by the sensor.

In contrast, the present disclosure proposes that the registration marks on the image bearing surface are monitored continuously for the position of the image on the image bearing surface. The target media on to which this specific image is to be transferred to is also monitored for position (e.g., by the sensors in the media handling subsystem). The present disclosure then determines a correction function that will make adjustments to the media velocity and/or angularity (skew) of the target media (e.g., on to which this specific image is to be transferred) such that the correction to the target media is made. In addition, the correction function will also make adjustments to the media velocity and/or angularity (skew) of the subsequent media (e.g., on to which the subsequent images are to be transferred). Further, the present disclosure proposes the registration marks added to the image bearing surface are in line with the image (e.g., a theoretical leading edge of the toner image on the image bearing surface) to be transferred, as described in detail later with respect to FIG. 4.

Figure 2:
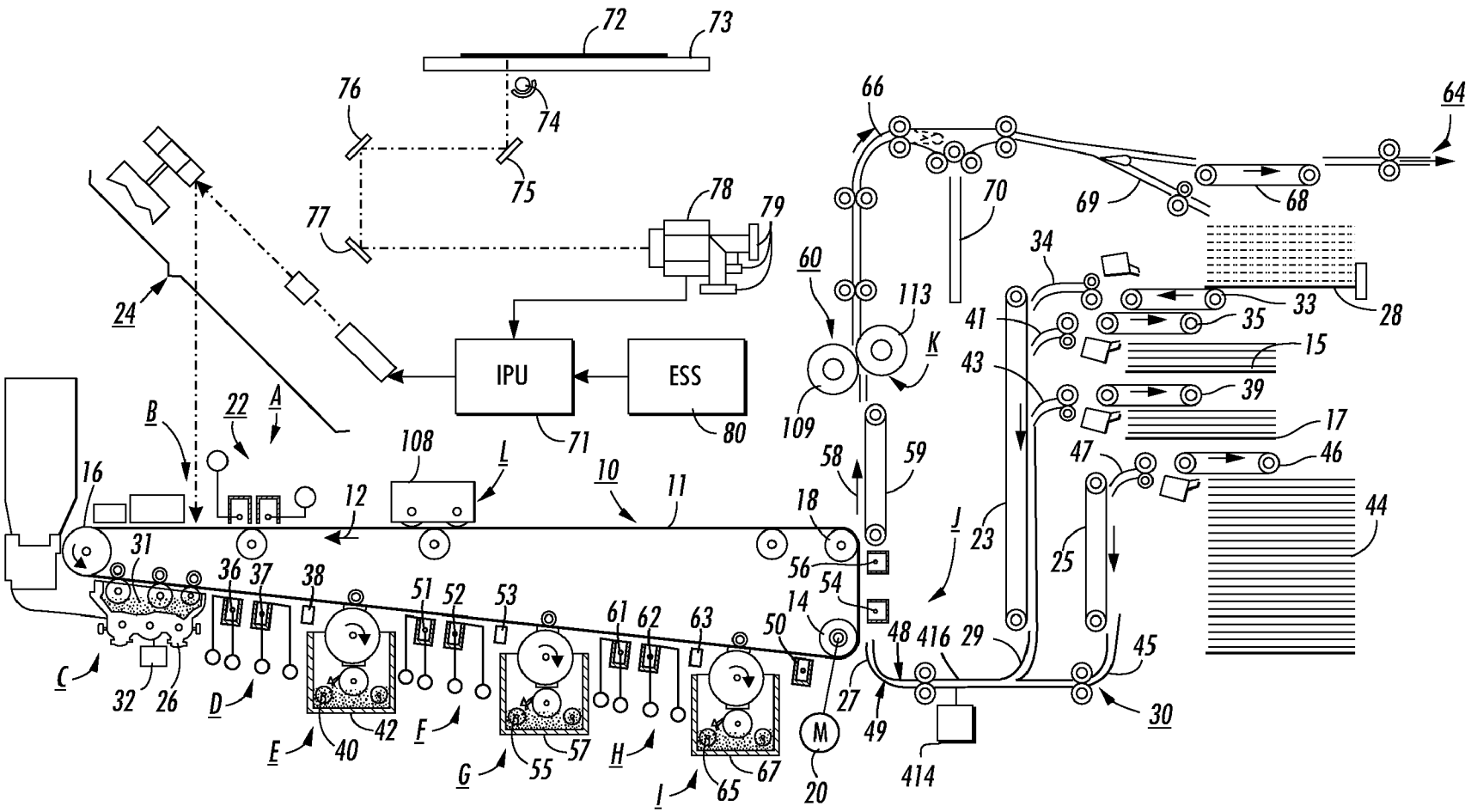
FIG. 2 shows an elevational view of an image printing system incorporating an image on paper registration system.

FIG. 2 schematically depicts the various elements of an illustrative image printing system. The term "image printing system" as used herein broadly encompasses various printers, copiers, multifunction machines or other image reproduction systems, xerographic or otherwise.

Referring to FIG. 2, the copy or scanning process generally involves a computer generated image which may be conveyed to an image processor (IPU) 71, or alternatively a media 72 may be placed on the surface of a transparent platen 73. A scanning assembly having a light source 74 illuminates the media 72. The light reflected from the media 72 is reflected by mirrors 75, 76, and 77, through lenses (not shown) and a dichroic prism 78 to three charged-coupled linear photosensing devices (CCDs) 79 where the information from the media 72 is read. Each CCD 79 outputs a digital two byte number which is proportional to the strength of the incident light. The digital signals represent each pixel (picture element) and are indicative of blue, green, and red densities. They are conveyed to the IPU 71 where they are formed into bit maps comprising yellow, cyan, magenta, and black. One skilled in the art will recognize that each bit map represents the exposure value for each pixel, the color component, and the color separation. The IPU 71 stores the bit maps for further instructions from an electronic subsystem (ESS) 80.

The ESS is a self-contained, dedicated mini-computer having a central processor unit (CPU), electronic storage, and a display or user interface (UI). It is the control system which prepares and manages the image data flow between IPU 71 and a scanning device 24, as well as being the main multitasking processor for operating all of the other machine subsystems and printing operations, such as imaging, developing, media delivery and transfer, and various functions associated with subsequent finishing processes. Some or all of these subsystems may have micro-controllers that communicate with the ESS 80.

The image printing system includes an image bearing surface 10, for example, in the form of a belt having a photoconductive surface layer 11 on an electroconductive substrate 13. Other suitable photoconductive surfaces and conductive substrates may also be employed. In one embodiment, the image bearing surface 10 of the image printing system is selected from the group consisting of a photoreceptor drum, a photoreceptor belt, an intermediate transfer belt, and an intermediate transfer drum. That is, the term image bearing surface means any surface on which a toner image is received, and this may be an intermediate surface (i.e., a drum or belt on which a toner image is formed prior to transfer to the printed document). For example, a "tandem" xerographic color printing systems (e.g., U.S. Pat. Nos. 5,278,589; 5,365,074; 6,904,255 and 7,177,585, each of which are incorporated by reference), typically include plural print engines transferring respective colors sequentially to an intermediate image transfer surface (e.g., belt or drum) and then to the final substrate.

In one embodiment, the image printing system generally has two important dimensions: the process (or slow scan) direction and the cross-process (or fast scan) direction. The direction in which the image bearing surface moves is referred to as process (or slow scan) direction, and the direction in which a plurality of sensors (as will be described in detail with respect to FIG. 4) are oriented is referred to as cross-process (or fast scan) direction. The cross-process (or fast scan) direction is generally perpendicular to the process (or slow scan) direction.

The image bearing surface 10 is driven by means of motor 20 having an encoder attached thereto (not shown) to generate a machine timing clock. The image bearing surface 10 moves along a path defined by rollers 14, 18, and 16 in a process direction as shown by arrow 12.

Initially, the image bearing surface 10 passes through charging station A where a corona generating device, indicated generally by the reference numeral 22, charges the image bearing surface 10 to a relatively high, substantially uniform potential. For purposes of example, the image bearing surface 10 is negatively charged, however it is understood that a positively charged the image bearing surface may be used by correspondingly varying the charge levels and polarities of the toners, recharge devices, and other relevant regions or devices involved in the image formation process.

Next, the charged portion of the image bearing surface 10 is advanced through an imaging station B. At the imaging station B, the uniformly charged image bearing surface 10 is exposed to the scanning device 24 which causes the image bearing surface 10 to be discharged in accordance with the output from the scanning device. The scanning device is a laser Raster Output Scanner (ROS). The ROS creates the image in a series of horizontal scan lines having a certain number of pixels per inch. It may include a laser with rotating polygon mirror blocks and a suitable modulator, or in lieu thereof, a light emitting diode array (LED) write bar. In addition to the image, the ROS writes registration marks or indicia on the image bearing surface 10.

At a first development station C, a magnetic brush developer unit, indicated generally by the reference numeral 26 advances developer material 31 into contact with the latent image and registration marks. The developer unit 26 has a plurality of magnetic brush roller members. These magnetic brush rollers transport negatively charged black toner material to the latent image and registration marks for development thereof. A power supply 32 electrically biases the developer unit 26.

At recharging station D, a pair of corona recharge devices 36 and 37 are employed for adjusting the voltage level of both the toned and untoned areas on the image bearing surface 10 to a substantially uniform level. A power supply is coupled to each of the electrodes of corona recharge devices 36 and 37. The recharging devices 36 and 37 substantially eliminate any voltage difference between toned areas and bare untoned areas, as well as to reduce the level of residual charge remaining on the previously toned areas, so that subsequent development of different color toner images is effected across a uniform development field.

Imaging devices 38, 53, and 63 are used to measure image registration on the image bearing surface 10, and to superimpose subsequent images by selectively discharging the recharged photoreceptor. These imaging devices may include, for example, a LED image array bar, or another ROS. Image registration of this type is described in U.S. Pat. No. 5,394,223 issued to Hart et al. in February, 1995, the relevant portions thereof being hereby incorporated into the present disclosure. On skilled in the art will appreciate that the imaging devices 38, 53, and 63 are controlled by ESS 80.

The imaging device 38 records a second electrostatic latent image on the image bearing surface 10. A negatively charged developer material 40, for example, yellow toner, develops the second latent image. The toner is contained in a developer unit 42 disposed at a second developer station E and is transported to the second latent image recorded on the image bearing surface by a donor roll. A power supply (not shown) electrically biases the developer unit to develop this latent image with the negatively charged yellow toner particles 40.

At a second recharging station F, a pair of corona recharge devices 51 and 52 are employed for adjusting the voltage level of both the toned and untoned areas on the image bearing surface 10 to a substantially uniform level. A power supply is coupled to each of the electrodes of corona recharge devices 51 and 52. The recharging devices 51 and 52 substantially eliminate any voltage difference between toned areas and bare untoned areas, as well as to reduce the level of residual charge remaining on the previously toned areas so that subsequent development of different color toner images is effected across a uniform development field.

A third latent image is recorded on the image bearing surface 10 by imaging device 53. This image is developed using a third color toner 55 contained in a developer unit 57 disposed at a third developer station G. An example of a suitable third color toner is magenta. Suitable electrical biasing of the developer unit 57 is provided by a power supply, not shown.

At a third recharging station H, a pair of corona recharge devices 61 and 62 adjust the voltage level of both the toned and untoned areas on the image bearing surface 10 to a substantially uniform level. A power supply is coupled to each of the electrodes of corona recharge devices 61 and 62. The recharging devices 61 and 62 substantially eliminate any voltage difference between toned areas and bare untoned areas as well as to reduce the level of residual charge remaining on the previously toned areas, so that subsequent development of different color toner images is effected across a uniform development field.

A fourth latent image is created using imaging device 63. The fourth latent image is formed on both bare areas and previously toned areas of the image bearing surface 10 that are to be developed with the fourth color image. This image is developed, for example, using a cyan color toner 65 contained in developer unit 67 at a fourth developer station I. Suitable electrical biasing of the developer unit 67 is provided by a power supply, not shown.

Developer units 42, 57, and 67 are preferably of the type known in the art which do not interact, or are only marginally interactive with previously developed images. For examples, a DC jumping development system, a powder cloud development system, and a sparse, non-contacting magnetic brush development system are each suitable for use in an image on image color development system.

In order to condition the toner for effective transfer to a substrate, a negative pre-transfer corotron member 50 negatively charges all toner particles to the required negative polarity to ensure proper subsequent transfer.

A media is advanced to a transfer station J by a sheet feeding apparatus 30. The term "media", "print media", or "sheet" herein refers to a usually flimsy physical sheet of paper, plastic, or other suitable physical print media substrate for images, whether precut or web fed. During simplex operation (single sided copy), a blank sheet or media may be fed from tray 15 or tray 17, or a high capacity tray 44 thereunder, to a media handling subsystem 416, in communication with controller 414, where the media is registered in the process and lateral directions, and for skew position. One skilled in the art will realize that trays 15, 17, and 44 each hold a different sheet type. Tray 15, for example, may feed 8.5 by 11 inch sheets, while tray 17 feeds 11 by 17 inch sheets, and high capacity tray 44 feeds 14.33 by 20.5 inch sheets.

The speed of the media is adjusted at the media handling subsystem 416 so that the media arrives at transfer station J in synchronization with the toner image on the surface of the image bearing surface 10. Sheet registration of this type is described in U.S. Pat. No. 4,971,304 issued to Robert M. Loftus in November 1990, the relevant portions thereof being hereby incorporated into the present disclosure. The media handling subsystem 416 receives a media from either a vertical transport 23 or a high capacity tray transport 25 and moves the received media to a pretransfer baffle 27. The vertical transport 23 receives the media from either tray 15 or tray 17, or the single-sided copy from duplex tray 28, and guides it to the media handling subsystem 416 via a turn baffle 29. Sheet feeders 35 and 39 respectively advance a copy media from trays 15 and 17 to the vertical transport 23 by chutes 41 and 43. The high capacity tray transport 25 receives the media from tray 44 and guides it to the media handling subsystem 416 via a lower baffle 45. A sheet feeder 46 advances copy media from tray 44 to transport 25 by a chute 47.

The pretransfer baffle 27 guides the media from the media handling subsystem 416 to transfer station J. Pretransfer baffle 27 is isolated from machine ground to prevent the discharge of the image bearing surface 10. Charge limiter 49 located on pretransfer baffle 27 restricts the amount of electrostatic charge a sheet can place on the baffle 27 thereby reducing image quality problems and shock hazards. The charge can be placed on the baffle from either the movement of the sheet through the baffle or by the corona generating devices located at transfer station J. When the charge exceeds a threshold limit, charge limiter 49 discharges the excess to ground.

Transfer station J includes a transfer corona device 54 which sprays positive ions onto the backside of the copy sheet. This attracts the negatively charged toner powder images from photoreceptor belt 10 to the sheet. A detack corona device 56 is provided for facilitating stripping of the sheet from the image bearing surface 10.

After transfer, the media continues to move, in the direction of arrow 58, onto a conveyor 59 which advances the media to fusing station K. The fusing station K includes a fuser assembly, indicated generally by the reference numeral 60, which permanently fixes the transferred color image to the copy media. Preferably, the fuser assembly 60 comprises a heated fuser roller 109 and a backup or pressure roller 113. The copy media passes between fuser roller 109 and backup roller 113 with the toner powder image contacting fuser roller 109. In this manner, the toner powder images are permanently fixed to the media. After fusing, chute 66 guides the advancing media to feeder 68 for exit to a finishing module (not shown) via output 64. However, for duplex operation, the media is reversed in position at inverter 70 and transported to duplex tray 28 via chute 69. Duplex tray 28 temporarily collects the media whereby sheet feeder 33 then advances it to the vertical transport 23 via chute 34. The media fed from duplex tray 28 receives an image on the second side thereof, at transfer station J, in the same manner as the image was deposited on the first side thereof. The completed duplex copy exits to the finishing module (not shown) via output 64.

After the media is separated from the image bearing surface 10, the residual toner carried on the image bearing surface is removed therefrom. The toner is removed at cleaning station L using a cleaning brush structure contained in a housing 108.

Figure 4:
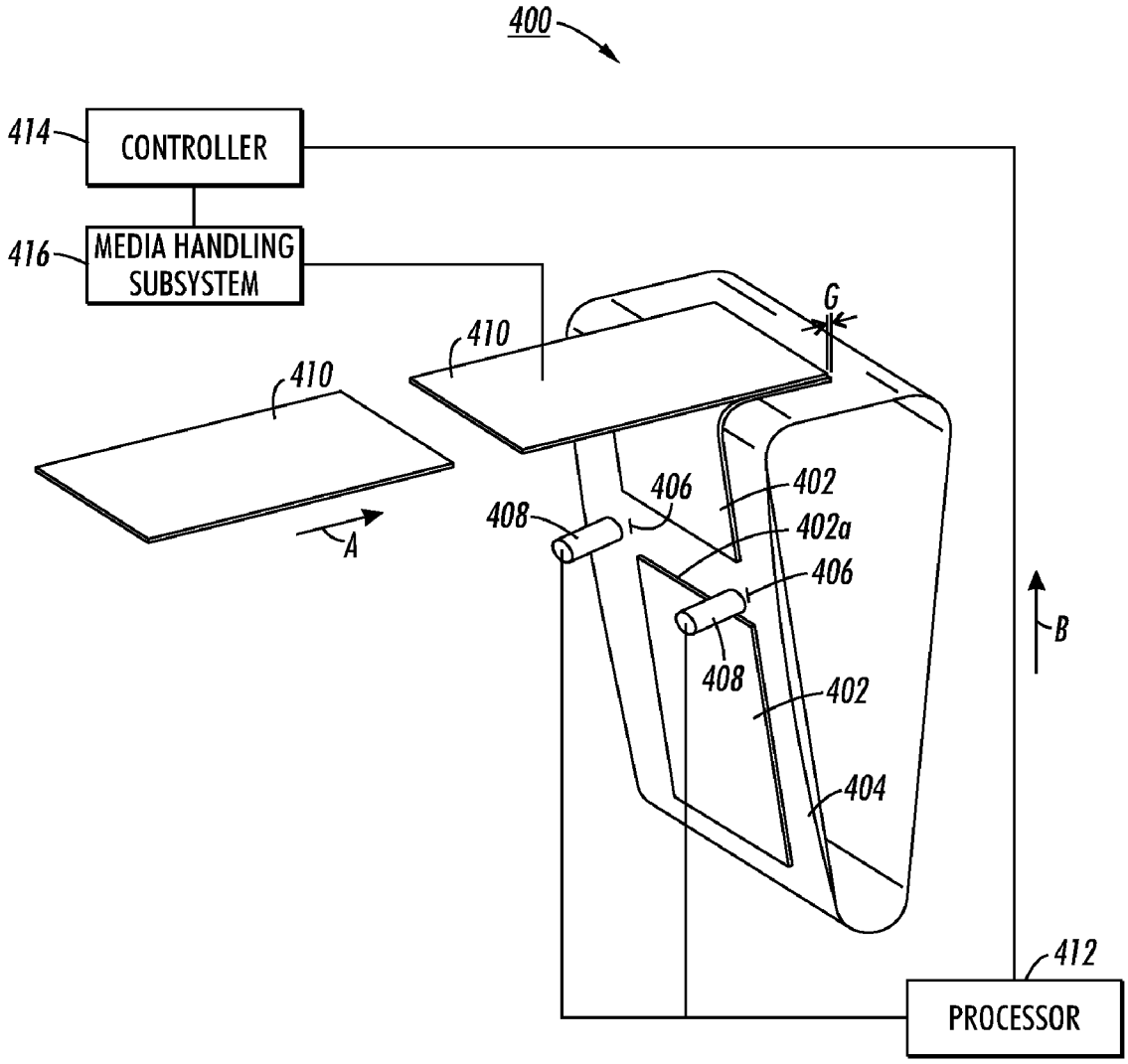
FIG. 4 shows a schematic view of an image on paper registration system in accordance with the present disclosure.

As shown in FIG. 4, the present disclosure provides a method for improving image on paper registration in an image printing system 400. The method comprises advancing a target media 410 along a media path; placing a plurality of registration marks 406 adjacent to a toner image 402 on an image bearing surface 404 moving in the process direction, wherein the toner image 402 is configured to be transferred to the target media 410; detecting positions of the registration marks 406 using one or more sensors 408 adjacent the image bearing surface 404; determining a correction function using the positions of the registration marks 406 to compensate for an error in a registration of the toner image 402 and the target media 410; adjusting the advancement of the target media 410 based on the correction function; and transferring the toner image 402 to the target media 410.

The term "target media" refers to the media on which the toner image is to be transferred. The target media 410 is advanced along the media path, which is shown by an arrow A. In one embodiment, the target media 410 is advanced along the media path A by a media handling subsystem 416.

Figure 1:
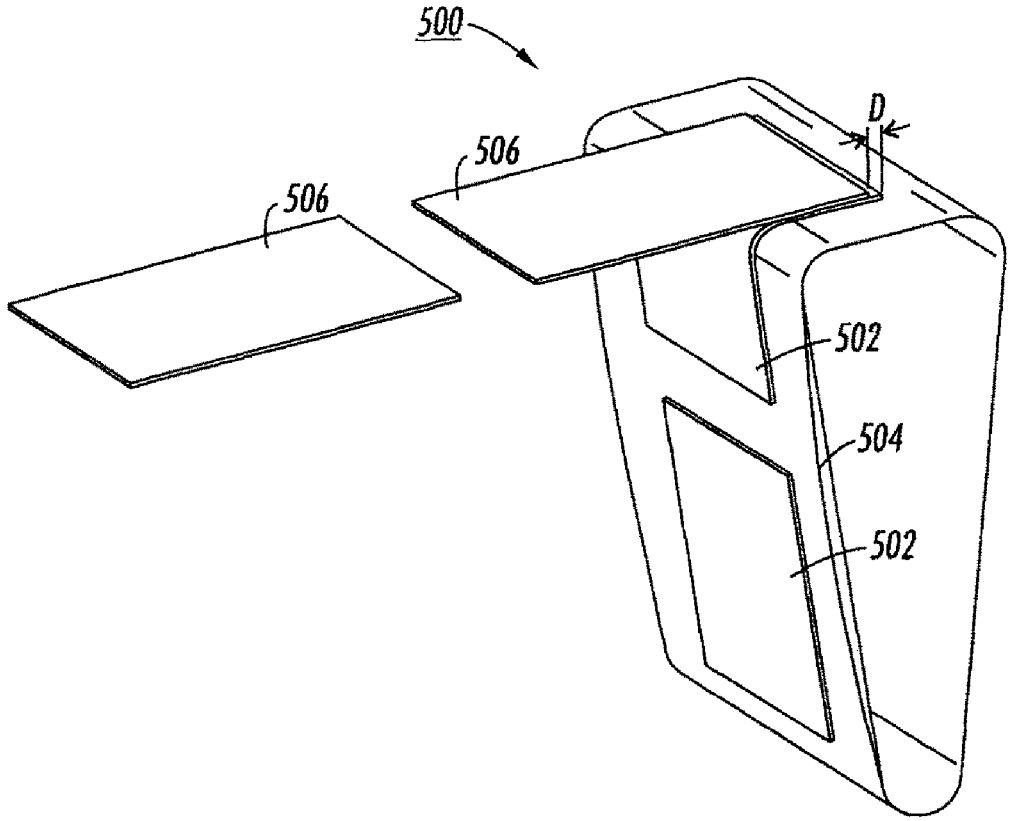
FIG. 1 (PRIOR ART)
FIG. 1 shows a prior art image on paper registration system.
Figure 3:
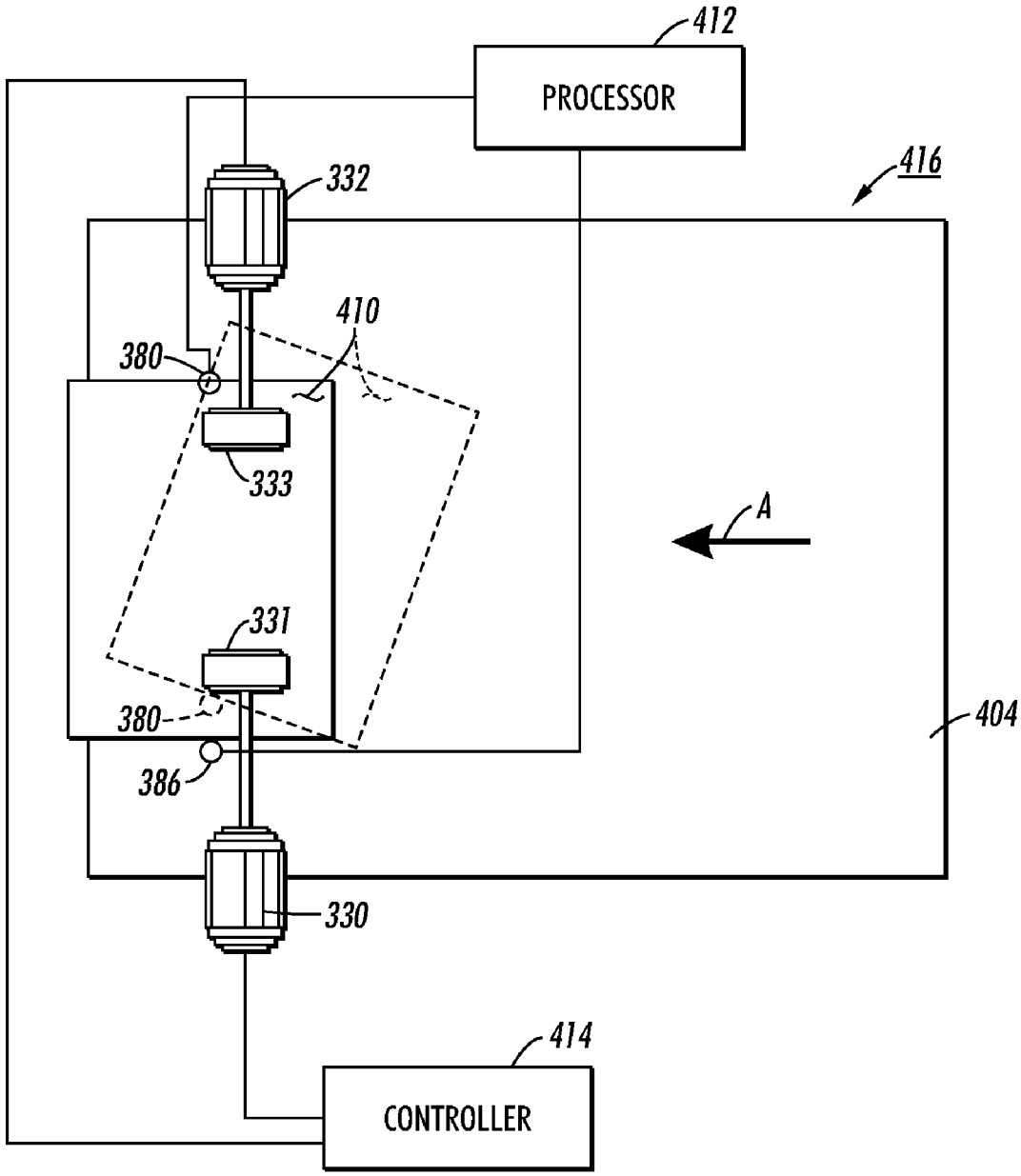
FIG. 3 shows a plan view of an edgeless registration transport.

The media handling subsystem 416 is shown and discussed in detail with respect of FIG. 3. The media handling subsystem 416 is configured to deliver the target media 410 to the transfer station J (as shown in the FIG. 1) of the image printing system at precisely specified time window in order to receive the toner image 402 (as shown in FIG. 4) on the image bearing surface 404. The media handling subsystem 416 includes media drive rolls 331 and 333 which are driven independently by two differential drive servo motor encoders 330 and 332, respectively. In one embodiment, the media handling subsystem 416 is configured to detect the position of the target media 410 and communicate this positional information of the target media 410 to a processor 412. In one embodiment, this detection is achieved by using a pair of lead edge sensors 380 and a side edge sensor 386. The pair of lead edge sensors 380 and the side edge sensor 386 are configured to communicate the positional information of the target media 410 to the processor 412.

In one embodiment, as shown in FIG. 4, the plurality of registration marks 406 are placed adjacent to the toner image 402 on the image bearing surface 404 that is moving in a process direction as shown by an arrow B. In one embodiment, the toner image 402 is configured to be transferred to the target media 410. In the illustrated embodiment, two registration marks 406 are placed outside the toner image 402. In the illustrated embodiment, two registration marks 406 are located at either end of the image bearing surface 404 along the cross-process direction. However, it is contemplated that the number and placement of the registration marks 406 can vary. In one embodiment, the registration marks 406 may include any shape, but not limited to, cross-hair or target mark shape, rectangular, circular, triangular, diamond-shaped or any other shape. In one embodiment, the particular shape of the registration marks is not important to the present disclosure. These registration marks 406 are used to ensure that the toner images 402 formed on the image bearing surface 404 are aligned with target media 410. In one embodiment, these registration marks 406 are placed using, for example, marking material, and may be removed later (e.g., after the toner image 402 is transferred to the target media 410) using a cleaner. In one embodiment, the registration marks 406 are placed and detected just prior to the transfer of the toner image 402 to the target media 410.

As noted above, in one embodiment, the registration marks 406 added to the image bearing surface 404 are positioned in line with a theoretical leading edge 402*a* of the toner image 402 on the image bearing surface 404. In another embodiment, the registration marks 406 added to the image bearing surface are positioned at a predetermined distance prior to the toner image 402 on the image bearing surface 404. In other words, the registration marks 406 are positioned at a predetermined distance prior to the theoretical leading edge 402*a* of the toner image 402 on the image bearing surface 404. These registration marks 406 may be placed any where on the image bearing surface 404 as long as these registration marks 406 are used to ensure that the toner images 402 formed on the image bearing surface 404 are aligned with target media 410.

In one embodiment, the positions of the registration marks 406 are detected using one or more sensors 408 positioned adjacent the image bearing surface 404. In one embodiment, the sensor(s) 408 may be a point sensor, which scans only a small portion of the width of the image bearing surface 404. In another embodiment, the sensor(s) 408 may be a full-width array (FWA) sensor which is configured to scan the entire width of the image bearing surface 404. In one embodiment, the positions of the registration marks 406 detected by the sensor(s) 408 are sent to the processor 412 for analysis. In the illustrated embodiment, two point sensors 408 are located such that the sensors 408 are configured to detect the registration marks 406 located at either end of the image bearing surface 404.

Upon receiving the positional information of the registration marks 406 from the sensor(s) 408, and the positional information of the target media 410 from the lead edge sensors 380 and the side edge sensor 386 of the media handling system 416, the processor 412 processes the positional information of the media 410 and the toner image 402, and determines the correction function to compensate for an error in a registration of the toner image 402 and the target media 410.

The processor 412 for processing the positional information of the registration marks 406 and the positional information of the target media 410 is provided to both calibrate the sensor(s) and to process the positional information detected by the sensor(s). It could be dedicated hardware like ASICs or FPGAs, software, or a combination of dedicated hardware and software. In one embodiment, the processor 412 may be an individual processor or multiple processors with the different functions (i.e., receiving the positional information of the target media from the from the lead edge sensors 380 and the side edge sensor 386 of the media handling system 416, and the positional information of the registration marks 406 from the sensor(s) 408; processing the positional information to determine the correction function) distributed among them.

In one embodiment, the error may include time of arrival of the registration marks 406 and the toner image 402 at the transfer station of the image printing system. In another embodiment, the error may include location of the registration marks 406 and the toner image 402 from the transfer station of the image printing system. In yet another embodiment, the error may include time of arrival of the registration marks 406 and the toner image 402 at the transfer station of the image printing system, and location of the registration marks 406 and the toner image 402 from the transfer station of the image printing system.

In one embodiment, the advancement of the target media 410 is adjusted by the controller 414 based on the correction function determined by the processor 412. The media handling subsystem 416 receives commands/signals from the controller 414 to adjust the advancement of the target media 410 based on the correction function determined by the processor 412. If angularity (skew) and/or offset are present in the alignment of target media 410 to the toner image 402, controller 414 corrects the condition by independently changing the appropriate drive parameters on the media handling subsystem 416 for the target media 410. In one embodiment, if there is an error in the time of arrival of the registration marks 406 and the toner image 402 at the transfer station of the image printing system, then the controller 414 corrects the condition by adjusting the media velocity parameter on the media handling system 416 for the target media 410. Based on the commands/signals received from the controller 414, the motors 330 and 332 of the media handling subsystem 416 correct the angularity (skew), media velocity, and/or relative position of the target media 410 (as shown in FIG. 4) by correspondingly driving a pair of rolls 331 and 332 so that the lead edge of media 410 (as shown in FIG. 4) meets the lead edge of the toner image 402 (as shown in FIG. 4) traveling on the image bearing surface 404 at transfer station J (shown in FIG. 2). In one embodiment, as shown in FIG. 4, the method for improving image on paper registration in the image printing system 400 disclosed in the present disclosure has reduced the positional difference G between the image 402 and the media 410.

It should be understood that the present disclosure applies to any combination of change in media velocity or movement/alignment of media within the image printing system in order to properly coordinate the movement or alignment of the target media (i.e., the media on to which the toner image is to be transferred) for transfer of the toner image on to the target media. Once the advancement of the target media 410 is adjusted based on the correction function, the toner image 402 is transferred to the target media 410.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the present disclosure following, in general, the principles of the present disclosure and including such departures from the present disclosure as come within known or customary practice in the art to which the present disclosure pertains, and as may be applied to the essential features hereinbefore set forth and followed in the spirit and scope of the appended claims.

What is claimed is:

1. A method for improving image on paper registration in an image printing system, the method comprising:

advancing a target media along a media path;

placing a plurality of registration marks adjacent to a toner image on an image bearing surface moving in a process direction, wherein the toner image is configured to be transferred to the target media;

detecting positions of the registration marks using one or more sensors adjacent the image bearing surface;

determining a correction function using the positions of the registration marks to compensate for an error in a registration of the toner image and the target media;

adjusting the advancement of the target media based on the correction function, wherein the adjusting comprises adjusting target media velocity parameter of the image printing system and adjusting alignment of the target media relative to the toner image and transferring the toner image to the target media, wherein the adjusting the alignment of the target media changes angularity, offset, or both of the target media.

2. A method according to claim 1, wherein the error is time of arrival of the registration marks and the toner image at a transfer station of the image printing system.

3. A method according to claim 1, wherein the error is location of the registration marks and the toner image from a transfer station of the image printing system.

4. A method according to claim 1, wherein the error is time of arrival of the registration marks and the toner image at a transfer station of the image printing system, and location of the registration marks and the toner image from the transfer station of the image printing system.

5. A method according to claim 1, wherein the correction function includes making adjustments to the target media based on the error in the registration of the toner image and the target media.

6. A method according to claim 1, wherein the registration marks are formed and detected just prior to the transfer of the toner image to the target media.

7. A method according to claim 1, wherein the registration marks are removed after the toner image is transferred to the target media.

8. A method according to claim 1, wherein the image bearing surface is at least one of a photoreceptor drum, a photoreceptor belt, an intermediate transfer belt, an intermediate transfer drum, and other image bearing surfaces.

9. A method according to claim 1, wherein the sensor is a linear array sensor.

10. A method according to claim 1, wherein the sensor is a point sensor.

11. A method according to claim 9, wherein the linear array sensor is a full width array (FWA) sensor.

12. A system for improving image on paper registration in an image printing system, the system comprising:

a media handling subsystem configured to advance a target media along a media path;

a marking engine configured to place a plurality of registration marks adjacent to a toner image on an image bearing surface moving in a process direction, wherein the toner image is configured to be transferred to the target media;

one or more sensors adjacent to the image bearing surface configured to detect positions of the registration marks;

a processor configured to determine a correction function using the positions of the registration marks to compensate for an error in a registration of the toner image and the target media; and a controller configured to adjust the advancement of the target media based on the correction function, wherein the marking engine is further configured to transfer the toner image to the target media, and wherein the controller is configured to adjust the advancement of the target media by adjusting target media velocity parameter on the media handling subsystem and by adjusting alignment of the target media relative to the toner image, wherein the controller is configured to correct angularity, offset, or both of the target media by changing the alignment of the target media.

13. A system according to claim 12, wherein the error is time of arrival of the registration marks and the toner image at a transfer station of the image printing system.

14. A system according to claim 12, wherein the error is location of the registration marks and the toner image from a transfer station of the image printing system.

15. A system according to claim 12, wherein the error is time of arrival of the registration marks and the toner image at a transfer station of the image printing system, and location of the registration marks and the toner image from the transfer station of the image printing system.

16. A system according to claim 12, wherein the correction function includes making adjustments to the target media based on the error in the registration of the toner image and the target media.

17. A system according to claim 12, wherein the registration marks are formed and detected just prior to the transfer of the toner image to the target media.

18. A system according to claim 12, wherein the registration marks are removed after the toner image is transferred to the target media.

19. A system according to claim 12, wherein the image bearing surface is at least one of a photoreceptor drum, a photoreceptor belt, an intermediate transfer belt, an intermediate transfer drum, and other image bearing surfaces.

20. A system according to claim 12, wherein the sensor is a linear array sensor.

21. A system according to claim 12, wherein the sensor is a point sensor.

22. A system according to claim 20, wherein the linear array sensor is a full width array (FWA) sensor.

* * * * *